US008052401B2

(12) United States Patent
Kovach et al.

(10) Patent No.: US 8,052,401 B2
(45) Date of Patent: Nov. 8, 2011

(54) DOUBLE-ACTING RADIAL PISTON HYDRAULIC APPARATUS

(75) Inventors: Joseph A. Kovach, Aurora, OH (US); Bruce D. Larkin, Plainwell, MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 1037 days.

(21) Appl. No.: 11/548,450

(22) Filed: Oct. 11, 2006

(65) Prior Publication Data

US 2007/0240563 A1 Oct. 18, 2007

Related U.S. Application Data

(60) Provisional application No. 60/725,397, filed on Oct. 11, 2005.

(51) Int. Cl.
*F04B 1/04* (2006.01)
*F04B 27/04* (2006.01)

(52) U.S. Cl. ..... 417/273; 91/491; 91/492

(58) Field of Classification Search ..... 417/273; 91/491, 492; 123/42, 61 R, 62, 63
See application file for complete search history.

(56) References Cited

U.S. PATENT DOCUMENTS 1,714,706 A * 5/1929 Wilking ..... 91/486
1,964,245 A * 6/1934 Benedek et al. ..... 92/256
1,998,004 A * 4/1935 Ernst ..... 91/477
2,251,662 A * 8/1941 Crumpler ..... 123/61 R
2,568,357 A * 9/1951 Moulden ..... 417/221
2,760,439 A * 8/1956 Crookston ..... 188/281
2,984,222 A * 5/1961 Smith ..... 91/481
3,220,316 A * 11/1965 Kummerman ..... 91/176
3,477,415 A 11/1969 Wyssbrod
3,521,533 A 7/1970 Avermaete
3,747,578 A * 7/1973 Pickens ..... 123/42
3,799,035 A 3/1974 Lamm
3,831,565 A 8/1974 Avery
3,865,093 A 2/1975 Ferragut Rodriguez
4,038,949 A 8/1977 Farris
4,062,330 A 12/1977 Billings
4,073,216 A 2/1978 Davis
4,136,646 A 1/1979 Lappa
4,339,988 A 7/1982 Steele
4,398,450 A * 8/1983 Louhio ..... 91/477
4,445,423 A * 5/1984 Louhio ..... 91/492
4,478,135 A 10/1984 Irwin
4,898,076 A * 2/1990 Bigo et al. ..... 91/491
(Continued)

FOREIGN PATENT DOCUMENTS

EP 1537333 6/2006
(Continued)

*Primary Examiner* — Devon C Kramer
*Assistant Examiner* — Peter J Bertheaud
(74) *Attorney, Agent, or Firm* — Renner, Otto, Boisselle & Sklar, LLP

(57) ABSTRACT

A hydraulic apparatus comprises a housing having a central axis; a plurality of radially-oriented piston-cylinder assemblies each including a cylinder supported by the housing and a piston movable within the cylinder, the piston separating radially inner and outer chambers within the cylinder; and valving and associated flow passages for individually controlling the flow of hydraulic fluid to and from the radially inner and outer chambers of each piston-cylinder assembly. The piston-cylinder assemblies are mounted to the housing for pivotal movement by trunnions provided with flow passages for connecting the piston-cylinder assemblies to inlet and outlet ports via the valving and porting.

19 Claims, 8 Drawing Sheets

U.S. PATENT DOCUMENTS

| | | | | | |
|---|---|---|---|---|---|
| 4,963,075 | A | * | 10/1990 | Albertson et al. | 417/273 |
| 5,049,039 | A | * | 9/1991 | Knoth et al. | 417/273 |
| 5,076,769 | A | * | 12/1991 | Shao | 417/534 |
| 5,478,218 | A | | 12/1995 | Gu | |
| 5,558,003 | A | * | 9/1996 | Bauzou et al. | 91/492 |
| 5,720,241 | A | | 2/1998 | Gail | |
| 5,967,018 | A | | 10/1999 | Breveglieri | |
| 2002/0168273 | A1 | | 11/2002 | Olson | |

FOREIGN PATENT DOCUMENTS

| | | |
|---|---|---|
| WO | 87/03042 | 5/1987 |

* cited by examiner

DOUBLE-ACTING RADIAL PISTON HYDRAULIC APPARATUS

RELATED APPLICATIONS

This application claims the benefit of U.S. Provisional Application No. 60/725,397 filed Oct. 11, 2005, which is hereby incorporated herein by reference.

FIELD OF THE INVENTION

The invention herein described relates to a hydraulic apparatus and, more particularly, to a hydraulic apparatus including a circumferential arrangement of double-acting piston-cylinder assemblies.

BACKGROUND

Radial piston hydraulic motors are well known in the art. Such radial piston hydraulic motors include a plurality of cylinders oriented in a radial direction relative to a central axis of the motor. In some conventional radial piston hydraulic motors, the cylinders are formed in a cylinder block to which an output shaft is connected. The cylinder block rotates within a housing having an undulating inner cam surface. Each cylinder receives a piston assembly provided with a roller at its radially outer end that engages the undulating cam surface of the housing. During operation, hydraulic fluid pressure forces the pistons radially outward and this causes the rollers to roll over the undulating surface. Reactionary forces act on the cylinder block and cause it and the output shaft to rotate.

Other conventional radial piston hydraulic motors include an output shaft that is mounted on a centrally located eccentric cam. A plurality of piston-cylinder assemblies are located radially outwardly of the eccentric cam with one surface of either the piston or the cylinder engaging the eccentric cam. Hydraulic fluid pressure provided to a chamber within each cylinder acts on the piston to cause relative movement between the piston and the cylinder. The relative movement between the piston and the cylinder results in a force being applied to the eccentric cam by the engaging surface. This force causes rotation of the eccentric cam and thus rotation of the output shaft.

SUMMARY OF THE INVENTION

According to one aspect of the invention, a hydraulic apparatus comprises a housing having a central axis; a plurality of radially-oriented piston-cylinder assemblies each including a cylinder supported by the housing and a piston movable within the cylinder, the piston separating radially inner and outer chambers within the cylinder; and valving and associated flow passages for individually controlling the flow of hydraulic fluid to and from the radially inner and outer chambers of each piston-cylinder assembly.

According to another aspect of the invention, a hydraulic apparatus comprises a housing having a central axis; and a plurality of radially-oriented piston-cylinder assemblies each including a cylinder and a piston movable within the cylinder, wherein each cylinder is mounted to the housing for pivotal movement; each piston has a piston rod extending through a radially inner end of the respective cylinder, and the radially inner ends of the piston rods are connected to a rotatably mounted eccentric to which a drive shaft is connected.

The cylinder of each piston-cylinder assembly may have trunnions pivotally supported by the housing, and the trunnions may include respective flow passages connected to the inner and outer chambers of the respective cylinder. The housing may include axially separable parts with one trunnion of each cylinder disposed in a bearing in one housing part and the other trunnion disposed in a bearing in the other housing part. In addition, the housing parts may each include a circumferential array of recesses in which respective cylinders are free to pivot relative to the housing.

Each piston may have a piston rod extending through a radially inner end of the respective cylinder, and the radially inner ends of the piston rods may be connected to a rotatably mounted eccentric to which a drive shaft is connected. The valving and flow passages may include a plurality of valves movable radially in a valve housing, which valves are moved in between open and closed positions in timed sequence with rotational motion of the drive shaft. A cam may be connected to the drive shaft, and the valves may have cam followers engaging the cam whereby the valves are opened and closed in timed relationship to rotation of the drive shaft.

An inlet port may be provided for connection to a source of pressurized hydraulic fluid and an outlet port for connection to a hydraulic fluid return, for causing rotation of the drive shaft when the hydraulic apparatus is used as a motor. Alternatively, an inlet port may be provided for connection to a source of hydraulic fluid and an outlet port for supplying pressurized hydraulic fluid to an external component, for pumping hydraulic fluid when the drive shaft is rotatably driven by an external device.

The hydraulic apparatus may be axially stacked against at least one other said hydraulic apparatus with the radially inner ends of the piston rods connected to a rotatably mounted eccentric to which the drive shaft is connected.

Further features of the invention will become apparent from the following detailed description when considered in conjunction with the drawings.

BRIEF DESCRIPTION OF THE DRAWINGS

In the annexed drawings.

DETAILED DESCRIPTION

Figure 1:
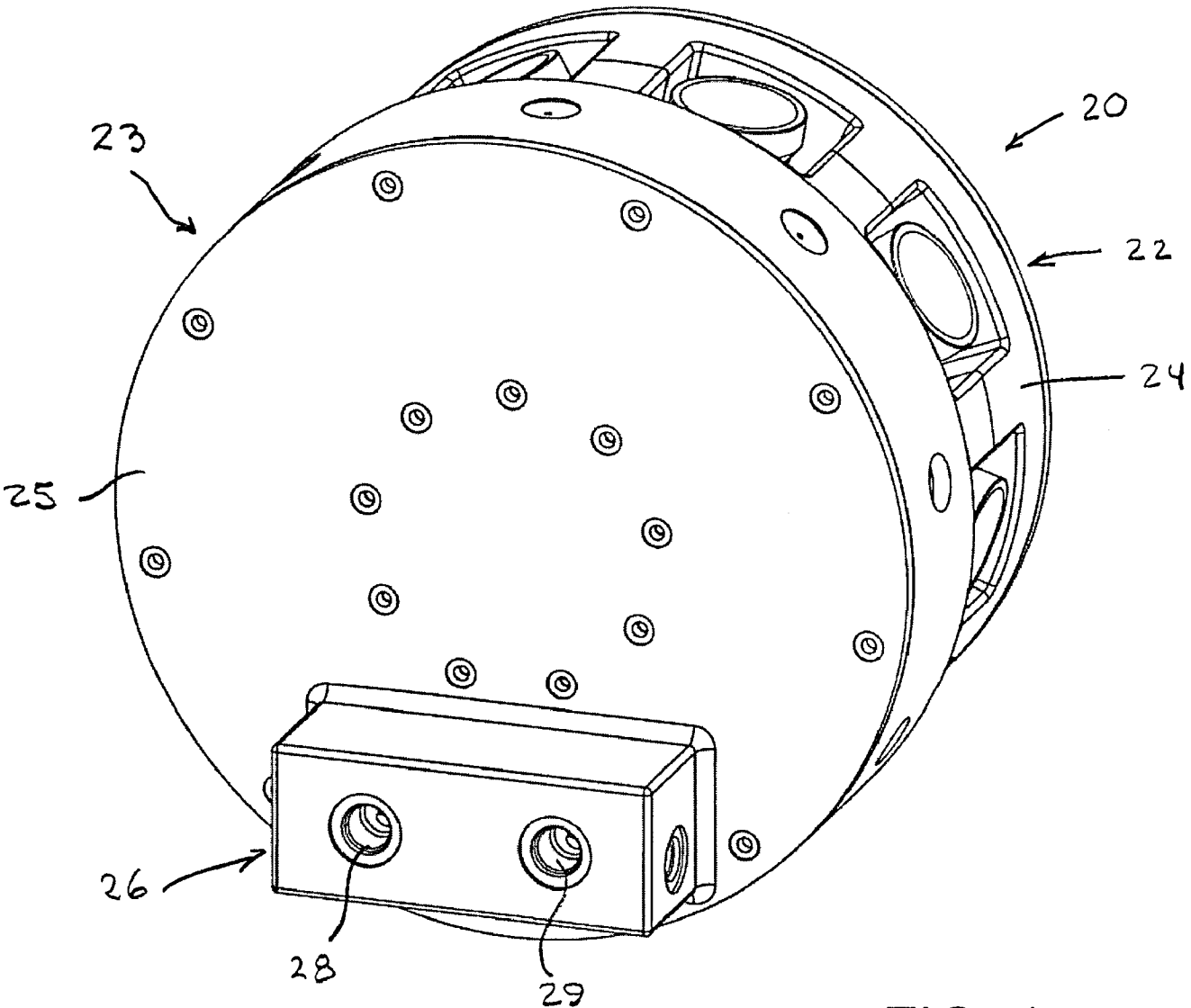
FIG. 1 is a perspective view of an exemplary hydraulic apparatus according to the present invention, which comprises a piston-cylinder module and a valve module.

Referring now in detail to the drawings and initially to FIG. 1, an exemplary hydraulic apparatus according to the invention is indicated generally at 20. The hydraulic apparatus may be a hydraulic motor or a hydraulic pump depending on whether pressurized hydraulic fluid is supplied to the apparatus for operation as a motor or the apparatus is driven by a prime mover, such as a motor, engine, windmill, etc. for operation as a pump. The description below for the most part refers to the apparatus as a hydraulic motor; however, those skilled in the art will recognize that the apparatus may alternatively be utilized as a hydraulic pump.

The hydraulic apparatus shown in FIG. 1 includes a drive module 22 and a valve module 23. In a preferred embodiment, the modules are in the form of blocks, preferably cylindrical, that can be stacked axially against one another. To this end, the drive module includes a cylindrical housing 24 and the valve module includes a cylindrical housing 25. The housing 25 has connected thereto for formed therewith a port block 26 including inlet and outlet ports 28 and 29. The ports 28 and 29 may be connected to an external source of pressurized hydraulic fluid and return for operation of the apparatus as a motor, or to a source of hydraulic fluid and a device to be powered by pressurized hydraulic fluid for operation of the device as a pump. As discussed below, fluid porting arrangements other than that shown may be utilized. Thus, the valve module may be replaced, for example, by a manifold including electrically powered valves for controlled operation of the hydraulic apparatus.

Figure 2:
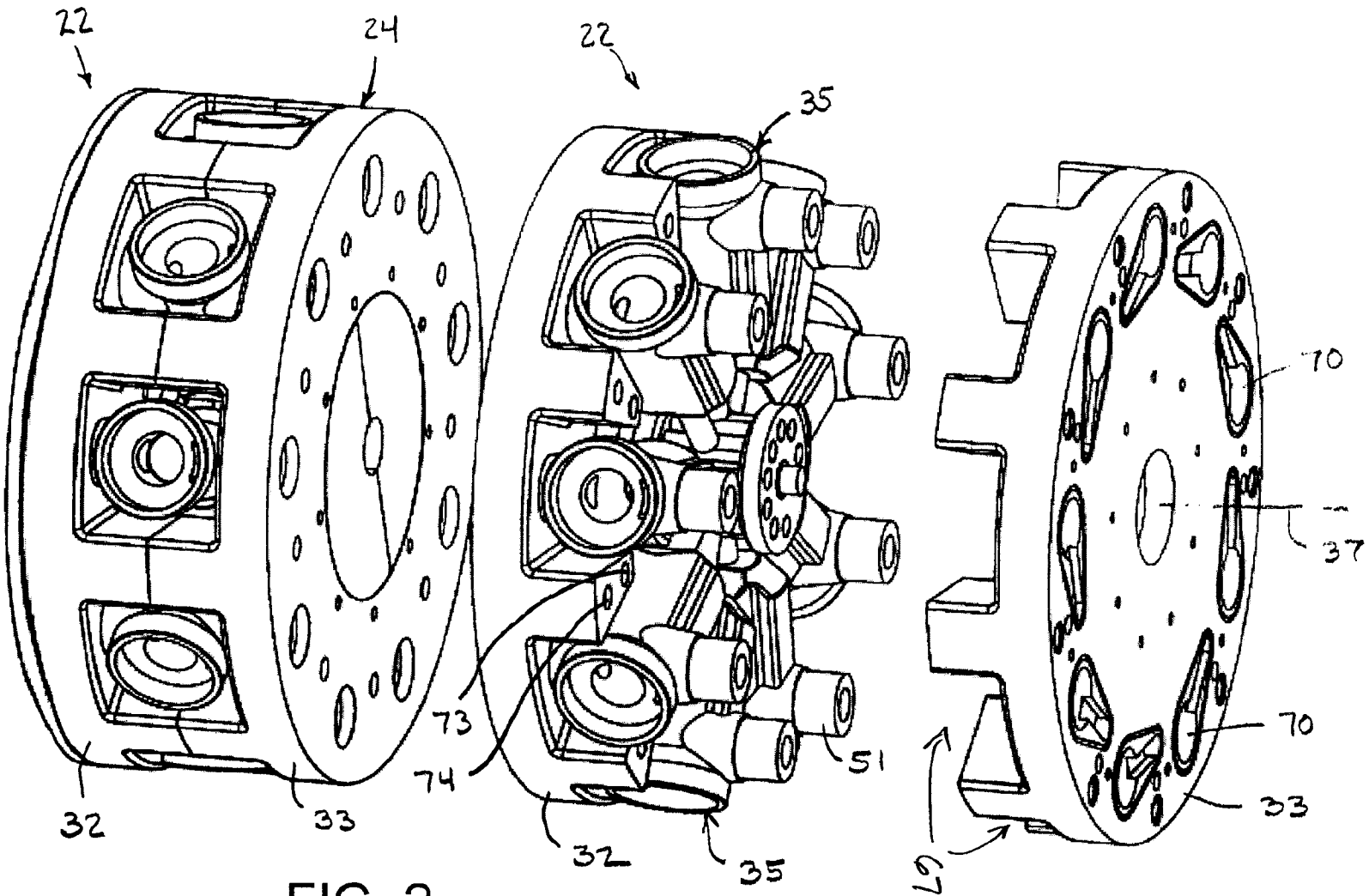
FIG. 2 is an exploded perspective view of the piston-cylinder module, shown in exploded stacked relationship to a second piston-cylinder module.
Figure 3:
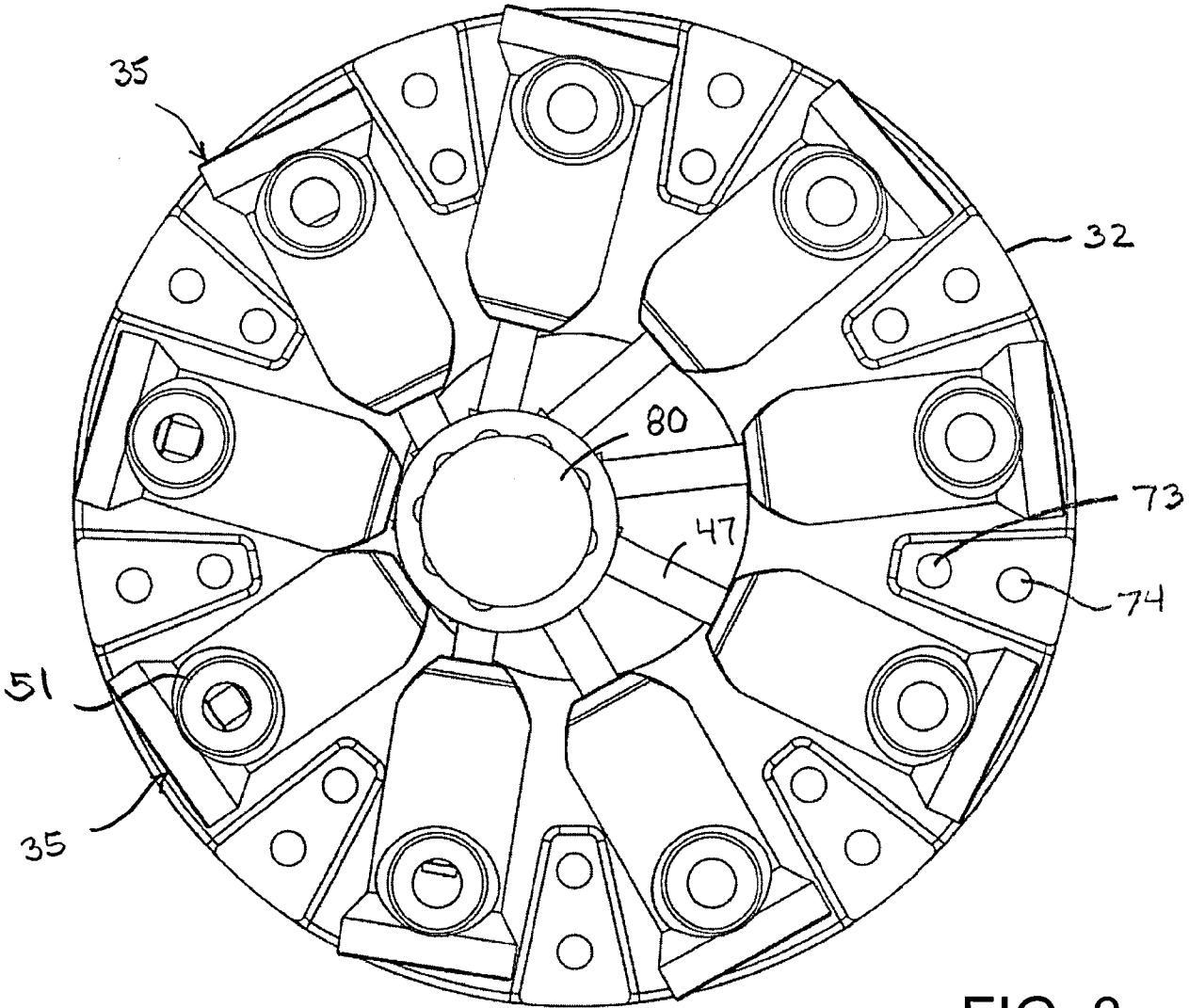
FIG. 3 is an elevational view looking from the line 2-2 of FIG. 2.
Figure 4:
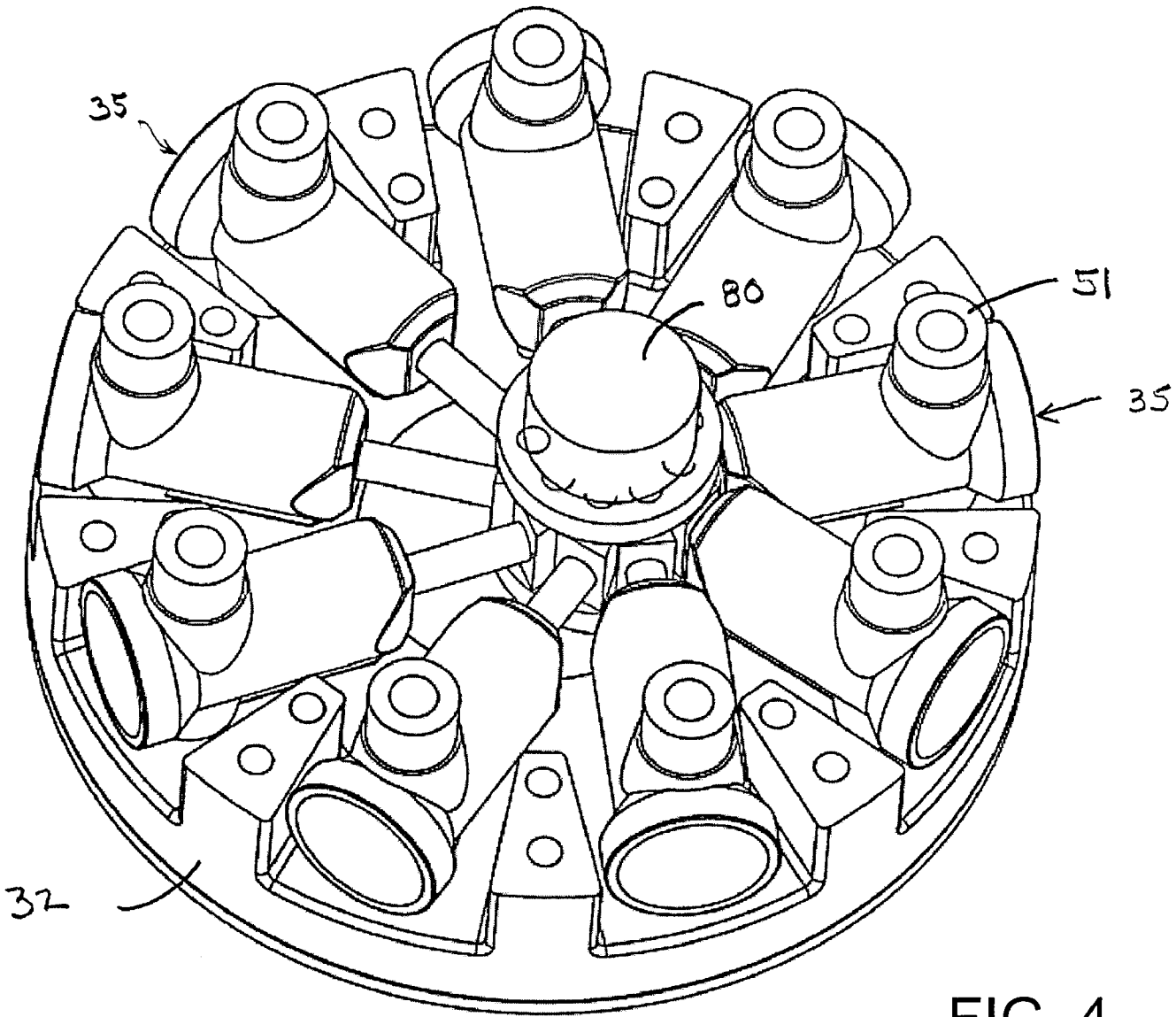
FIG. 4 is a perspective view showing the piston-cylinder assemblies of the hydraulic apparatus assembled to one of the mounting plates of the apparatus.

Referring now to FIG. 2, two drive modules 22 are shown in exploded relationship, with the right-hand module shown with one part of its housing 24 shown exploded away from the balance of the apparatus. As will be appreciated, any number of drive modules may be axially stacked together as may be desired for a given application.

In the illustrated embodiment, the housing 24 of each drive module 22 has first and second parts or halves 32 and 33 that may be in the form of plates that may mate along a central plane of the housing. The housing parts support therebetween a circumferential and preferably coplanar arrangement of radially oriented piston-cylinder assemblies 35. The piston-cylinder assemblies 35, which may be identical to one another, may be circumferentially equally spaced apart in concentric relation to the center axis 37 of the housing 24.

Figure 5:
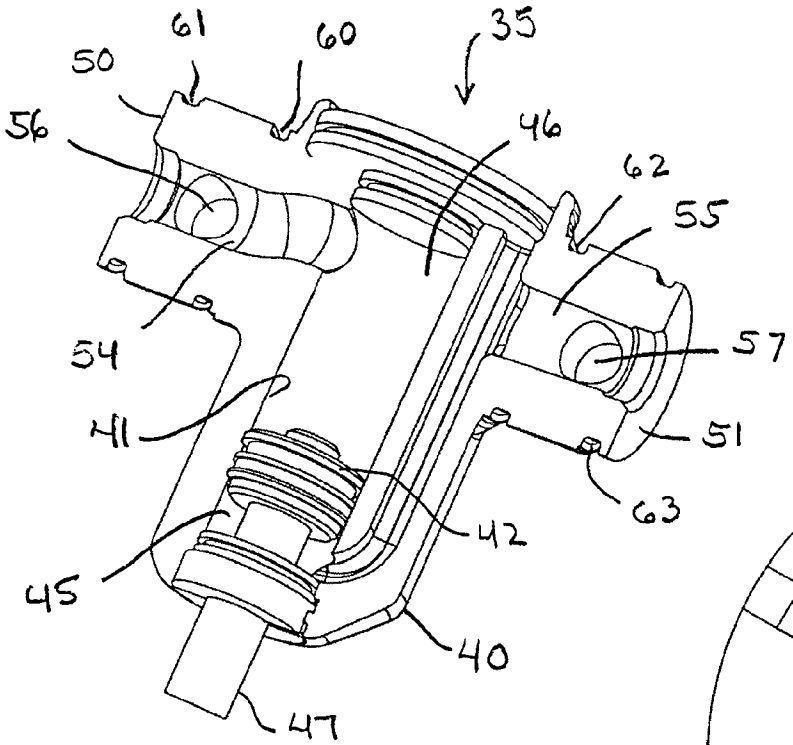
FIG. 5 is a perspective view of one of the piston-cylinder assemblies used in the hydraulic apparatus, shown partly broken away in section.
Figure 6:
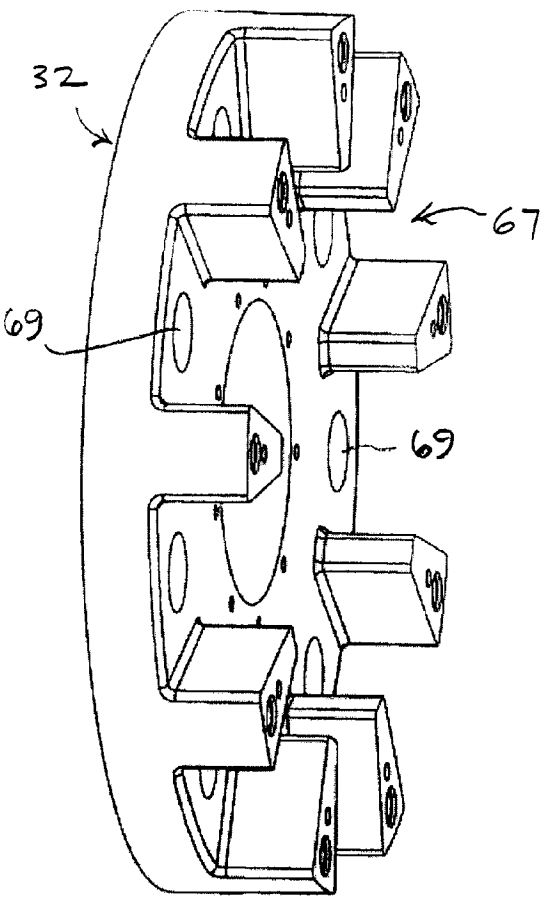
FIG. 6 is a perspective view of the mounting plate with the piston-cylinder assemblies removed.

In FIG. 5, an exemplary piston-cylinder assembly 35 is shown. The assembly 35 includes a cylinder 40 including a center bore 41 and a piston 42 movable in the center bore. As is well known, the piston may have one or more annular grooves formed in it radially outer surface for receiving a suitable seal that seals the piston to the inner wall of the cylinder. Consequently, the piston 42 divides the center bore of the cylinder into radially inner and outer chambers 45 and 46. The piston has connected thereto a piston rod 47 that extends through the radially inner end of the cylinder 40. In the illustrated embodiment the piston rod is sealed by suitable means to the cylinder to prevent leakage of hydraulic fluid along the rod passing through the end of the cylinder.

As shown, the cylinder 46 may be provided with a pair of trunnions 50 and 51 whereby the cylinder may be mounted for pivotal movement in the housing 24 as discussed further below. The trunnions 50 and 51 preferably include respective flow passages 54 and 55 that connect respective ports 56 and 57 in the trunnions to flow passages in the cylinder that lead to the radially outer and inner chambers 46 and 45, respectively. The trunnion 50 may also be provided with inner and outer annular grooves 60 and 61 on opposite sides of the port 56 for sealing against leakage along the trunnion when the cylinder is mounted in the housing 24. The trunnion 51 may have a similar arrangement of grooves 62 and 63 for receiving seals.

Referring now to FIGS. 2-4 and 6, the housing parts 32 and 33 each have formed therein recesses 67 that are aligned in opposition with the recesses in the other housing part. The aligned recesses extend radially from the central region of the housing 24 and accommodate pivotal movement of the piston-cylinder assemblies 35 received therein. The piston-cylinder assemblies have the trunnions 50 and 51 thereof received in bores 69 and 70 in the housing parts 33 and 32 for relative pivotal movement. The trunnion receiving bores 69 and 70 in the housing parts may be provided with suitable bearings or bearing surfaces for providing relatively friction-free pivoting movement of the trunnions in the housing parts. The pivotal connection of the cylinders to the housing helps to substantially reduce side loading during movement of the pistons relative to the cylinders. This reduction in side loading helps to increase motor efficiency.

Although not shown, the trunnion-receiving bores 69 and 70 have side ports for fluid communication with the ports 56 and 57 in the trunnions 50 and 51. The side ports in the bores in the housing part 32 connect to respective axial passages 73 in the housing part 32 and the side ports in the bores in the other housing part 33 connect to respective axial passages 74. The axial passages 73 and 74 in the housing parts connect with corresponding axial passages of one another, and the passage may extend between outer axial end surfaces of the housing 24 for connection with like passages in another drive module stacked in juxtaposition therewith, or to the valve module 23 or other flow control device. This arrangement provides for a ganged connection between one or more modules of the apparatus.

With the foregoing mounting arrangement of the piston-cylinder assemblies, the rods thereof all extend radially inwardly for connection to a eccentric cam or crank of a drive shaft 80. Such connection may be effected by engagement with a cam surface or by pivotal connection to the crank of the drive shaft, for example. When the hydraulic apparatus is operated as a motor, phased extension and retraction of the piston-cylinder assemblies effects rotation of the drive shaft. When the hydraulic apparatus is operated as a pump, rotation of the drive shaft will effect phased extension and retraction of the piston-cylinder assemblies.

Figure 8:
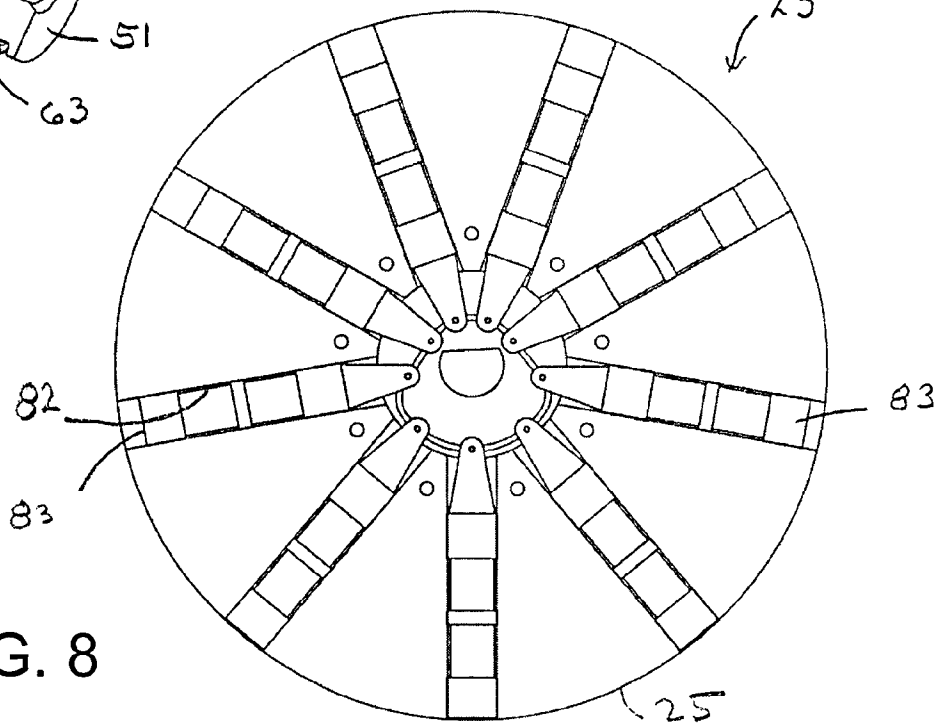
FIG. 8 is a cross-sectional view of the valve module, taken along the line 8-8 of FIG. 7.
Figure 7:
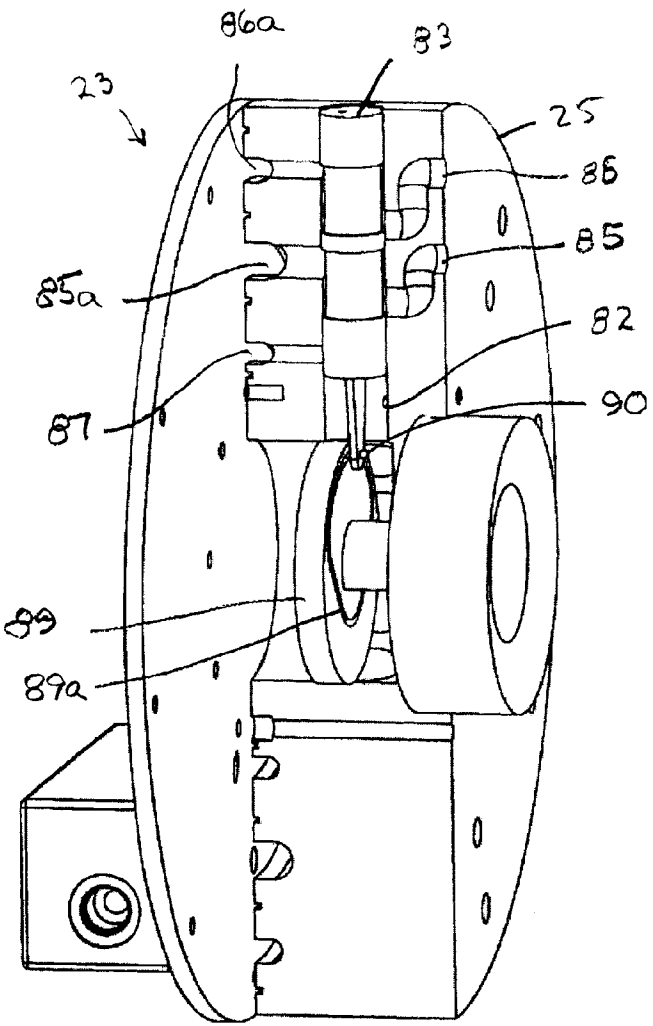
FIG. 7 is a perspective view of the valve module, shown partly broken away in section.

In the hydraulic apparatus shown in FIG. 1, flow of hydraulic fluid to and from the piston-cylinder assemblies is controlled by the valve module 23. As shown in FIGS. 7 and 8, the housing 25 of the valve module 23 includes a plurality of circumferentially arranged bores 82 in which respective spool valves 83 are radially movable. The spool valves function to controllably connect the inlet and outlet ports 28 and 29 (FIG. 1) to ports 85 and 86 that respectively connect with the axial passages 73 and 74 in the housing 24 of the drive module 22. For example, shifting of a spool valve 83 to a radially outer position will connect one of the inlet and outlet ports to the radially inner chamber 45 of a respective piston-cylinder assembly 35 and the other port to the radially outer chamber 46. Conversely, shifting of the spool valve to a radially inner position will connect the inlet and outlet ports in reverse manner. To this end, the valve module housing may have three concentric annular passages with the middle passage 85*a* connected to one of the inlet and outlet ports 28 and 29 and the other two passages 86*a* and 87 connected to the other of the inlet and outlet ports. The passages 85*a*, 86*a*, and 87 connect to the spool bore at radially spaced apart positions as shown in FIG. 7. Likewise, port passages 85 and 86 connect to the spool bore at radially spaced apart positions.

Phased movement of the spool valves 83 is coordinated (timed) with movement of the drive shaft 80. To this end, a timing cam 89 is provided. In the illustrated embodiment, the cam has a groove 89*a* in an axial end face with receives axial cam follower pins 90 connected to radially inner ends of the spool valves. As the cam rotates with the drive shaft, the spool valves will be controllably moved radially inwardly and outwardly for controlled supply of hydraulic fluid to and from the piston-cylinder assemblies 35.

Fluid flow to and from both chambers 45 and 46 of each piston-cylinder assembly 35, as above described, is controlled whereby the piston-cylinder assembly will be "double acting." "Double acting" in the context of this application means that the piston-cylinder assembly may provide an output force during an up-stroke (radially outward movement of the piston) and during a down-stroke (radially inward movement of the piston). Since all of the upper surface of the piston 42 is available for contact with fluid within the radially outer chamber, a large displacement is available using the radially outer chamber. The piston rod 47 decreases the working area of the bottom surface of the piston. As a result, the displacement available using the radially inner chamber 45 is less then that available using the radial outer chamber 46 in the illustrated embodiment.

Various valve configurations may be associated with the hydraulic apparatus depending upon the desired use. The "double acting" piston-cylinder assemblies 35 enable three operating modes for the hydraulic apparatus. In a first operating mode, valving may be associated with the piston-cylinder assemblies for providing an output force during both the up-stroke and the down-stroke. In a second operating mode, valving may be associated with the piston-cylinder assemblies for providing an output force only during the up-stroke. In a third operating mode, valving may be associated with the piston-cylinder assemblies for providing an output force only during the down-stroke.

These various valve configurations may include arrangements other than that afforded by the above-described valve module 23. For instance, high speed, electronically controlled valves may be used during the "double acting mode" so that high pressure fluid may be input into one chamber during expansion of the chamber and the other chamber may be connected to an associated reservoir during contraction of that chamber.

Figure 9:
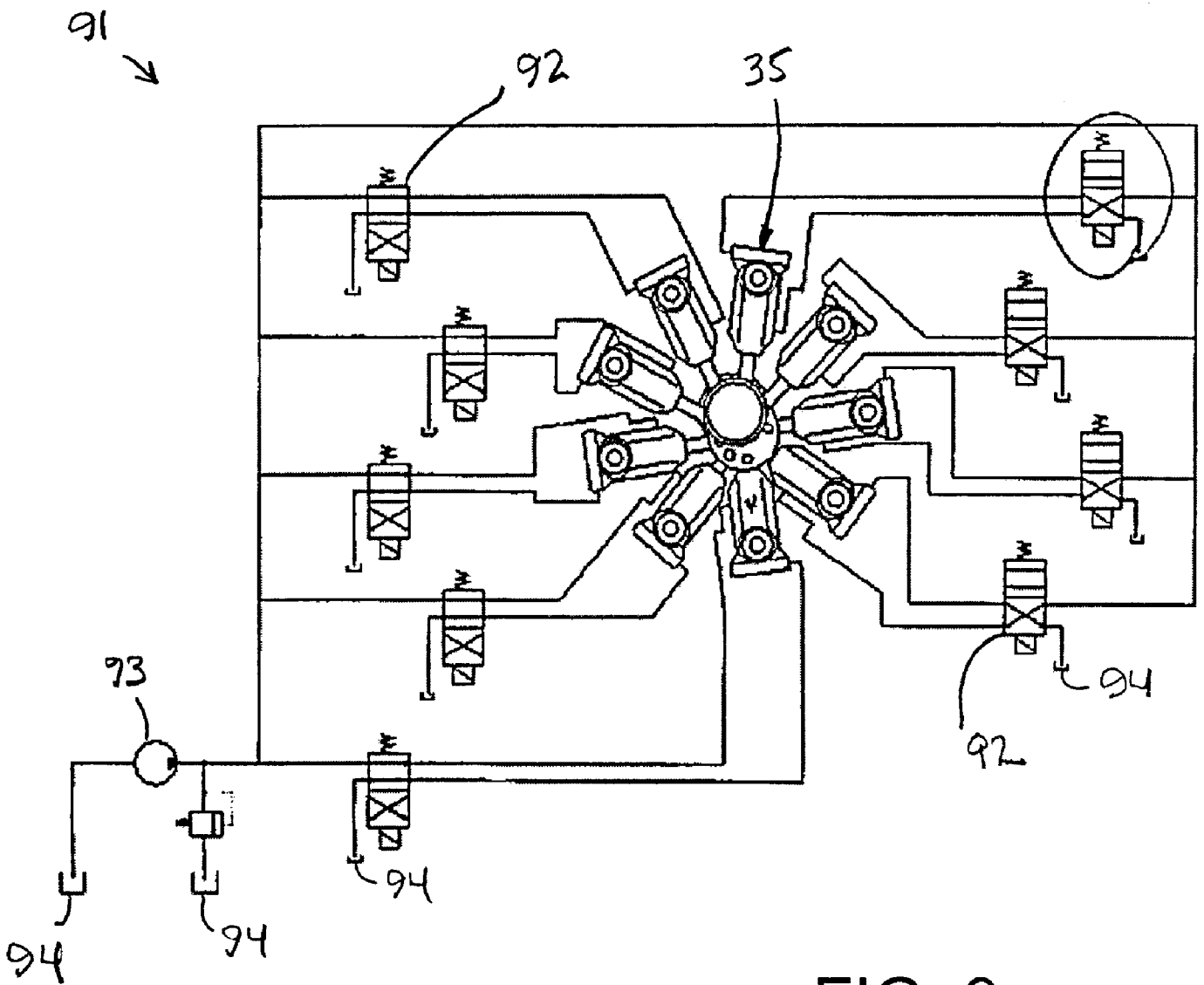
FIG. 9 is a schematic of an electronically controlled valving configuration for the hydraulic apparatus.

FIG. 9 illustrates a valve configuration that may be used in a "double acting mode" of the hydraulic apparatus when configured for operation as a hydraulic motor 91. The valve configuration of FIG. 9 includes multiple four-way valves 92, with one valve associated with each piston-cylinder assembly 35. The four-way valves may be high speed, solenoid operated valves. When the valves 92 are in a first position, the radially inner chamber of each piston-cylinder assembly is in fluid communication with a pump 93 of the hydraulic system and the radially outer chamber of each piston-cylinder assembly is in fluid communication with a reservoir 94 of the hydraulic system. When the solenoids are operated to switch the positions of the valves, the radially inner chamber of each piston-cylinder assembly is in fluid communication with the reservoir and the radially outer chamber of each piston-cylinder assembly is in fluid communication with the pump. The position of each valve is controlled to control the output speed of the output shaft of the motor.

Figure 10:
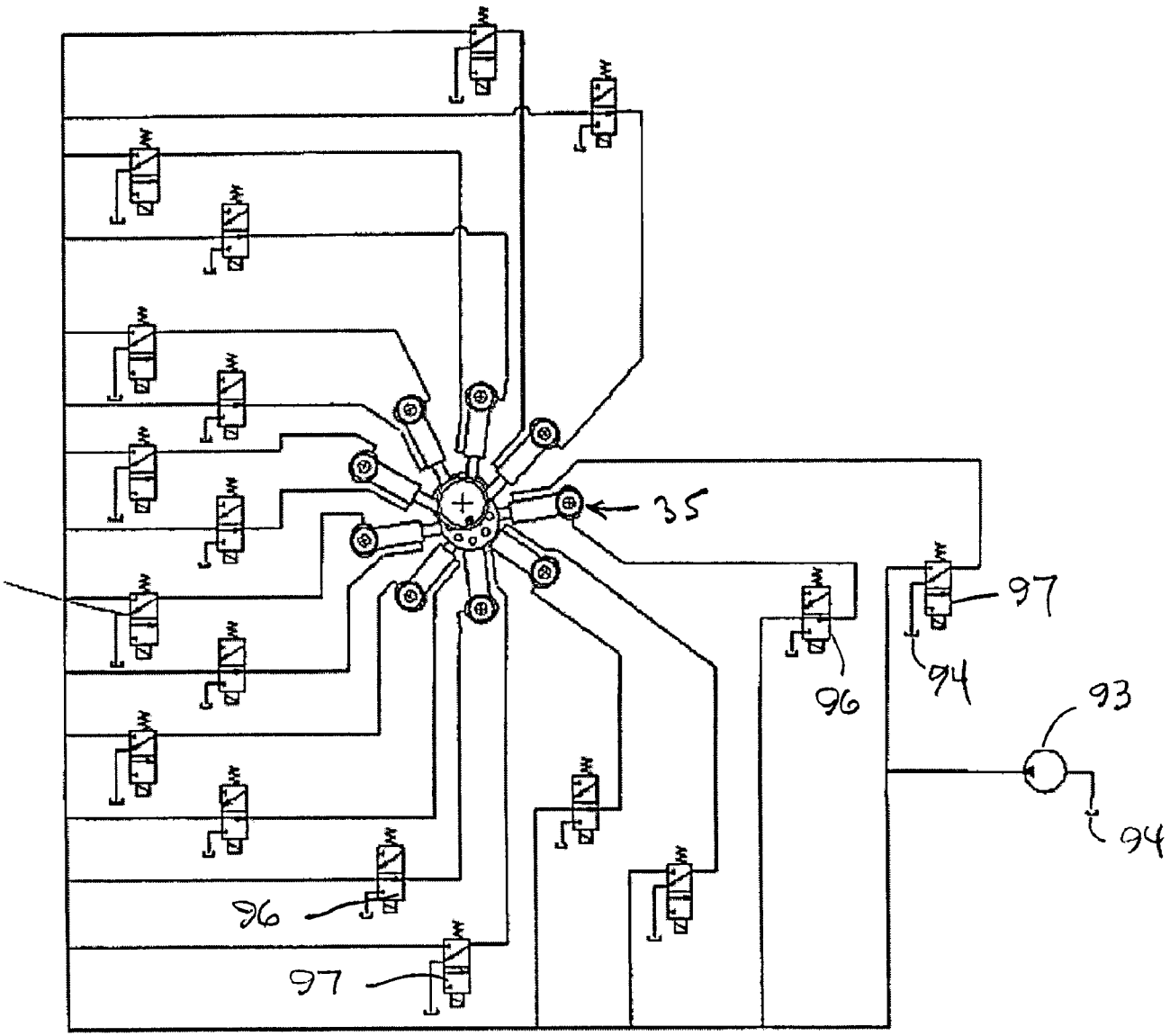
FIG. 10 is a schematic of another electronically controlled valving configuration for the hydraulic apparatus.

FIG. 10 illustrates a valve configuration that may be used with any of the three modes of operation. In the valve configuration illustrated in FIG. 10, two three-way valves 96 and 97 are associated with each piston-cylinder assembly 35. One three-way valve is associated with each flow passage of the piston-cylinder assembly. The three-way valves 96 and 97 are preferably high speed, solenoid operated valves controlled by a suitable controller.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic apparatus comprising:

a piston-cylinder housing having a central axis;

a plurality of radially-oriented piston-cylinder assemblies each including a cylinder and a piston movable within the cylinder, the piston separating radially inner and outer chambers within the cylinder, wherein each cylinder is mounted to the housing for pivotal movement; wherein each piston has a piston rod extending through the radially inner chamber and a radially inner end of the respective cylinder, and wherein the radially inner ends of the piston rods are connected to a rotatably mounted eccentric to which a drive shaft is connected; and valving and associated flow passages for individually controlling the flow of hydraulic fluid to and from the radially inner and outer chambers of each piston-cylinder assembly;

wherein the valving and flow passages include a plurality of valves movable radially in a valve housing, wherein the valves are moved in between open and closed positions in sequence with rotational motion of the eccentric;

wherein the valving and associated flow passages include, for each of the valves, a pair of ports in the valve housing, one of which is in fluid communication with the inner chamber of one of the cylinders, and the other of which is in fluid communication with the outer chamber of the one of the cylinders, wherein 1) when each valve is in a first position a fluid inlet of the valve housing is in fluid communication with the inner chamber and a fluid outlet of the valve housing is in fluid communication with the outer chamber, and 2) when each valve is in a second position the fluid outlet of the valve housing is fluid communication with the inner chamber and the fluid inlet of the valve housing is in fluid communication with the outer chamber;

wherein each of the valves includes a valve spool in a circumferential bore;

wherein the valve housing has three annular passages in communication with the circumferential valve bores, with the annular passages including a middle passage between the other two passages; and wherein the middle passage is in communication with one of the fluid inlet or the fluid outlet, and the other two passages are in communication with the other of the fluid inlet or the fluid outlet.

2. A hydraulic apparatus as set forth in claim 1, wherein the valve housing is stacked against an axial end of the piston-cylinder housing.

3. A hydraulic apparatus as set forth in claim 1, including a cam connected to the drive shaft, and wherein the valves have cam followers engaging the cam whereby the valves are opened and closed in timed relationship to rotation of the drive shaft.

4. A hydraulic apparatus as set forth in claim 1, wherein the eccentric includes the crank of a crankshaft forming the drive shaft.

5. A hydraulic apparatus as set forth in claim 1, wherein the fluid inlet is for connection to a source of pressurized hydraulic fluid and the fluid outlet is for connection to a hydraulic fluid return, for causing rotation of the drive shaft.

6. A hydraulic apparatus as set forth in claim 1, wherein the fluid inlet is for connection to a source of hydraulic fluid and the fluid outlet is for supplying pressurized hydraulic fluid to an external component, for pumping hydraulic fluid when the drive shaft is rotatably driven by an external device.

7. A hydraulic apparatus comprising:

a housing having a central axis;

a plurality of radially-oriented piston-cylinder assemblies each including a cylinder supported by the housing and a piston movable within the cylinder, the piston separating radially inner and outer chambers within the cylinder; and valving and associated flow passages for individually controlling the flow of hydraulic fluid to and from the radially inner and outer chambers of each piston-cylinder assembly, for providing a net force on each of the pistons using either of the chambers;

wherein the flow passages include flow passages in the housing;

wherein the valving and associated flow passages include a plurality of valves movable radially in a valve housing in sequence with rotational motion of a drive shaft mechanically coupled to the pistons;

wherein the valving and associated flow passages include, for each of the valves, a pair of ports in the valve housing, one of which is in fluid communication with the inner chamber of one of the cylinders, and the other of which is in fluid communication with the outer chamber of the one of the cylinders, wherein 1) when each valve is in a first position a fluid inlet of the valve housing is in fluid communication with the inner chamber and a fluid outlet of the valve housing is in fluid communication with the outer chamber, and 2) when each valve is in a second position the fluid outlet of the valve housing is fluid communication with the inner chamber and the fluid inlet of the valve housing is in fluid communication with the outer chamber;

wherein the valve housing has three annular passages in communication with the circumferential valve bores, with the annular passages including a middle passage between the other two passages; and wherein the middle passage is in communication with one of the fluid inlet or the fluid outlet, and the other two passages are in communication with the other of the fluid inlet or the fluid outlet.

8. A hydraulic apparatus as set forth in claim 7, wherein the valve spools are mechanically coupled to a timing cam that rotates with the drive shaft.

9. A hydraulic apparatus as set forth in claim 8, wherein the cam has a groove therein that receives axial cam follower pins connected to radially inner ends of the valve spools.

10. A hydraulic apparatus as set forth in claim 7, wherein the piston-cylinder assemblies are mounted to the housing for pivotal movement.

11. A hydraulic apparatus as set forth in claim 10, wherein the cylinder of each piston-cylinder assembly has trunnions pivotally supported by the housing.

12. A hydraulic apparatus as set forth in claim 11, wherein the trunnions include respective flow passages connected to the inner and outer chambers of the respective cylinder.

13. A hydraulic apparatus as set forth in claim 12, wherein the housing includes axially separable parts with one trunnion of each cylinder disposed in a bearing in one housing part and the other trunnion disposed in a bearing in the other housing part.

14. A hydraulic apparatus as set forth in claim 12, wherein the housing parts each include a circumferential array of recesses in which respective cylinders are free to pivot relative to the housing.

15. A hydraulic apparatus as set forth in claim 7, wherein each piston has a piston rod extending through a radially inner end of the respective cylinder, and the radially inner ends of the piston rods are connected to a rotatably mounted eccentric to which the drive shaft is connected.

16. A hydraulic apparatus as set forth in claim 15, including a cam connected to the drive shaft, and wherein the valves have cam followers engaging the cam whereby the valves are opened and closed in timed relationship to rotation of the drive shaft.

17. A hydraulic apparatus as set forth in claim 15, wherein the eccentric includes a crank of a crankshaft connected to the drive shaft.

18. A hydraulic apparatus as set forth in claim 15, wherein the fluid inlet is for connection to a source of pressurized hydraulic fluid and the fluid outlet is for connection to a hydraulic fluid return, for causing rotation of the drive shaft.

19. A hydraulic apparatus as set forth in claim 7, wherein the fluid inlet is for connection to a source of hydraulic fluid and the fluid outlet is for supplying pressurized hydraulic fluid to an external component, for pumping hydraulic fluid when a drive shaft is rotatably driven by an external device.

* * * * *